US008322809B2

(12) United States Patent
Kudo et al.

(10) Patent No.: US 8,322,809 B2
(45) Date of Patent: Dec. 4, 2012

(54) RECORDING HEAD AND RECORDING APPARATUS USING RECORDING HEAD

(75) Inventors: Tomoko Kudo, Kawasaki (JP); Tatsuo Furukawa, Zama (JP); Nobuyuki Hirayama, Fujisawa (JP); Ryo Kasai, Tokyo (JP); Tomoyuki Inoue, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 554 days.

(21) Appl. No.: 12/492,819

(22) Filed: Jun. 26, 2009

(65) Prior Publication Data

US 2010/0097418 A1 Apr. 22, 2010

(30) Foreign Application Priority Data

Jun. 27, 2008 (JP) ..... 2008-169335

(51) Int. Cl.
*B41J 29/38* (2006.01)

(52) U.S. Cl. ..... 347/12; 347/5; 347/13

(58) Field of Classification Search ..... 347/5, 9, 347/12, 13

See application file for complete search history.

(56) References Cited

U.S. PATENT DOCUMENTS

| | | | | |
|---|---|---|---|---|
| 6,296,340 | B1 * | 10/2001 | Tajika et al. | 347/12 |
| 2005/0116975 | A1 | 6/2005 | Kasai | |
| 2009/0009546 | A1 | 1/2009 | Kasai | |

FOREIGN PATENT DOCUMENTS

| | | |
|---|---|---|
| JP | 2000-263770 | 9/2000 |
| JP | 2005-161682 | 6/2005 |

* cited by examiner

*Primary Examiner* — Lam S Nguyen
(74) *Attorney, Agent, or Firm* — Canon USA Inc IP Division

(57) ABSTRACT

A recording head having a plurality of recording elements that are grouped into a plurality of blocks and ejecting ink by driving the recording elements in a time-divisional manner includes driving units configured to drive the recording elements, an input unit configured to receive an enable signal that defines a period during which the driving of the recording elements is enabled at one ink ejection, and a control unit configured to control the time-divisional driving by the driving units on the basis of pulses detected during the period defined by the enable signal received by the input unit.

4 Claims, 10 Drawing Sheets

RECORDING HEAD AND RECORDING APPARATUS USING RECORDING HEAD

BACKGROUND OF THE INVENTION

1. Field of the Invention

The present invention relates to recording heads and recording apparatuses using the recording heads.

2. Description of the Related Art

FIG. 9 is a block diagram illustrating an example circuit configuration of a known recording head. Heaters 401 are recording elements for generating thermal energy. Switching elements 402 are drivers for supplying desired current to the heaters. Each driver is connected to a corresponding recording element. A shift register 403 receives a data signal DATA in a serial manner on the basis of a clock signal CLK. The data signal DATA includes information on block specification and image data. The data in the shift register 403 is latched by a latch circuit 406 in synchronization with a latch signal LT.

A decoder 414 decodes the information on the block specification, and outputs signals to AND circuits 404 on the basis of the decoded results. In this manner, the recording elements to be driven at the same time are selected.

FIG. 10 is a timing chart of the signals for driving the known recording elements. The data signal DATA is transferred to the shift register 403 shown in FIG. 9 in synchronization with the clock signal CLK. The data signal DATA includes 4-bit information (B0 to B3) on the block specification and 16-bit image data (D0 to D15). Herein, sixteen recording elements constitute one block, and the 16-bit data is transferred such that each of the data components is assigned to a corresponding recording element. Further, the recording head includes sixteen blocks, and the 4-bit information (B0 to B3) is used for specifying the blocks.

When the latch signal LT is input to the latch circuit 406, the data signal DATA is held by the latch circuit 406. When a heat-enable signal HE is active (low level), the switching elements 402 can be turned on. VH and GND shown in FIG. 9 denote voltage applied to the recording elements and a ground signal, respectively.

Japanese Patent Laid-Open No. 2005-161682 describes driving of recording elements and control of a latch circuit by using both a heat-enable signal HE and a latch signal LT.

On the other hand, Japanese Patent Laid-Open No. 2000-263770 describes driving of recording elements at timings differing for each of the recording elements so as to realize an ink-jet recording apparatus with higher recording speed and higher image quality.

Not only recording apparatuses with higher recording speed and higher image quality described above, a demand for recording apparatuses with reduced noise emission is increasing. However, an additional function for reducing noise emission requires additional terminals for inputting new signals to recording heads. The additional terminals disadvantageously lead to a reduction in the reliability of wiring connections and an increase in chip area.

SUMMARY OF THE INVENTION

The present invention is directed to a recording head and a recording apparatus.

According to an aspect of the present invention, a recording head having a plurality of recording elements that are grouped into a plurality of blocks and ejecting ink by driving the recording elements in a time-divisional manner includes driving units configured to drive the recording elements, an input unit configured to receive an enable signal that defines a period during which the driving of the recording elements is enabled at one ink ejection, and a control unit configured to control the time-divisional driving by the driving units on the basis of pulses detected during the period defined by the enable signal received by the input unit.

Further features of the present invention will become apparent from the following description of exemplary embodiments with reference to the attached drawings.

DESCRIPTION OF THE EMBODIMENTS

First Exemplary Embodiment

Figure 1A:
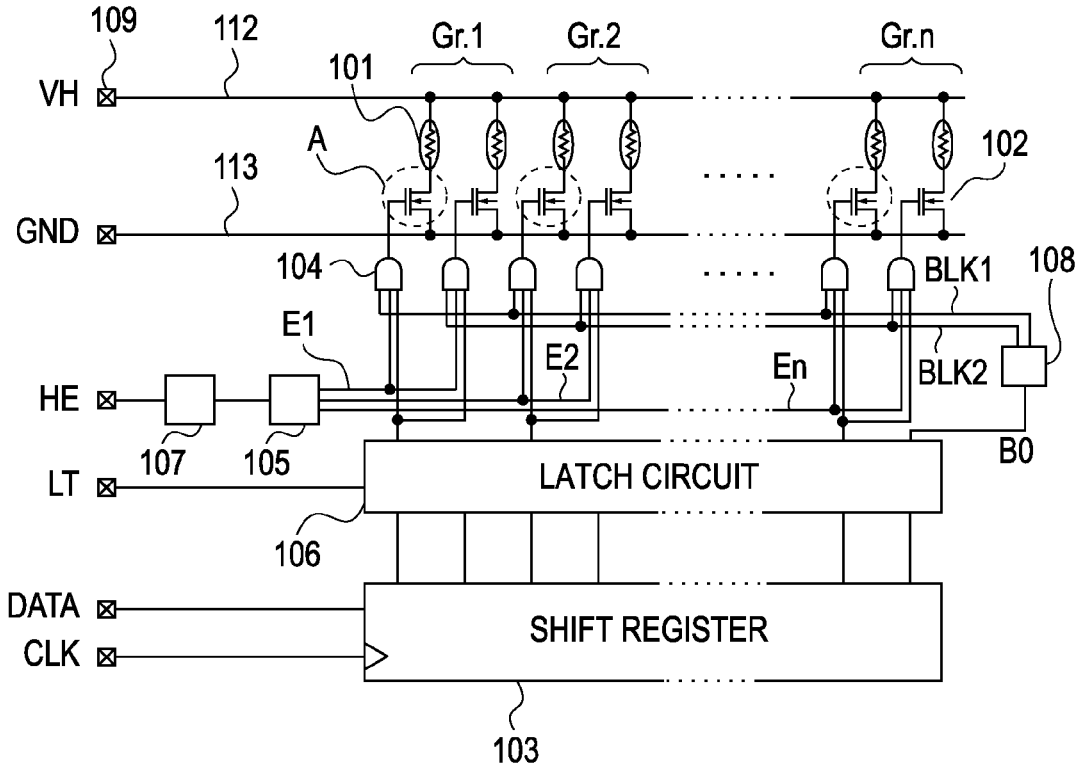
FIGS. 1A and 1B illustrate an example driving circuit of a recording head according to a first exemplary embodiment of the present invention.

FIG. 1A is a block diagram illustrating an example equivalent circuit of an ink-jet recording head according to a first exemplary embodiment of the present invention. FIG. 1A schematically illustrates the layout of circuit blocks on a board.

In FIG. 1A, the recording head includes a plurality of (2×n) recording elements (resistive heating elements). The resistive heating elements (heaters) 101 generate thermal energy. Switching elements (MOS transistors) 102 switch on or off current supply to the heaters. The heaters 101 are grouped into n groups (Gr. 1 to Gr. n). For ease of explanation, one group includes two heaters in this exemplary embodiment. In order to be driven at the same time, n switching elements 102, enclosed by broken-line circles (shown by A), of all the switching elements 102 are connected to a first control line (BLK1). Similarly, n switching elements 102 that are not enclosed by the broken-line circles are also connected to a second control line (BLK2) so as to be driven at the same time. That is, the number of time divisions (sharing) of the recording head in this exemplary embodiment is two. Therefore, the recording head includes two blocks. Moreover, the recording elements included in the n groups are assigned to the first block or the second block. In other words, n (positive integer) recording elements are assigned to one block.

A shift register 103 temporarily stores block information B0 and image data to be output to the heaters 101. A latch circuit 106 holds the block information B0 and the image data output from the shift register 103 in a parallel manner. Upon receiving a latch signal LT, the latch circuit 106 latches block information B0 and the image data. Decoder 108 inputs block information B0 from the latch circuit 106 and generates signal of BLK1, BLK2. Selection of block to be driven is based on signal of BLK1, BLK2.

A pulse-detecting circuit (pulse-generating circuit) 107 detects (extracts) pulses superimposed on the heat-enable signal HE, and outputs a control signal NP including pulses with a predetermined width to a timing circuit 105 in synchronization with the detection of the pulses. The recording head includes a plurality of pad 109 for receiving an electric power, heat-enable signal HE, latch signal LT, data signal DATA, clock signal CLK.

Figure 1B:
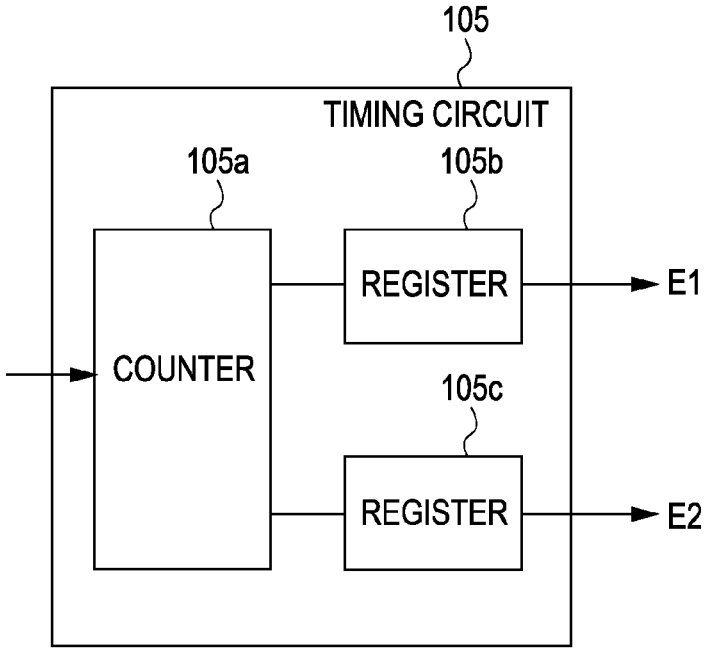

As shown in FIG. 1B, the timing circuit 105 includes a counter 105*a* and registers 105*b* and 105*c*. For ease of explanation, the number of group is two. The counter 105*a* counts the number of pulses in the control signal NP output from the pulse-detecting circuit 107. Each register of registers corresponds to each group of groups. The registers 105*b* and 105*c* refer to the value of the counter 105*a*, and output enable signals E1 and E2, respectively, when the count value reaches corresponding preset values. In addition, the registers 105*b* and 105*c* each have preset count values for starting and stopping output of the enable signals.

Therefore, when the number of groups is eight, for example, the timing circuit includes eight registers and outputs enable signals E1 to E8.

With reference to FIG. 1A, the switching element 102 enclosed by the circle A in the group Gr. 1, for example, can be switched on while the enable signal E1 is output from the register 105*b*. AND circuits 104 perform logical operation using signal of BLK1 and BLK2 and image data output from the latch circuit 106. When the image data is to be recorded, the switching element 102 enclosed by the circle A is switched on. The same applies to the groups Gr. 2 to Gr. n.

A power-supply line 112 supplies a predetermined voltage VH to the heaters 101. A GND line 113 is connected to the switching elements 102.

Figure 2:
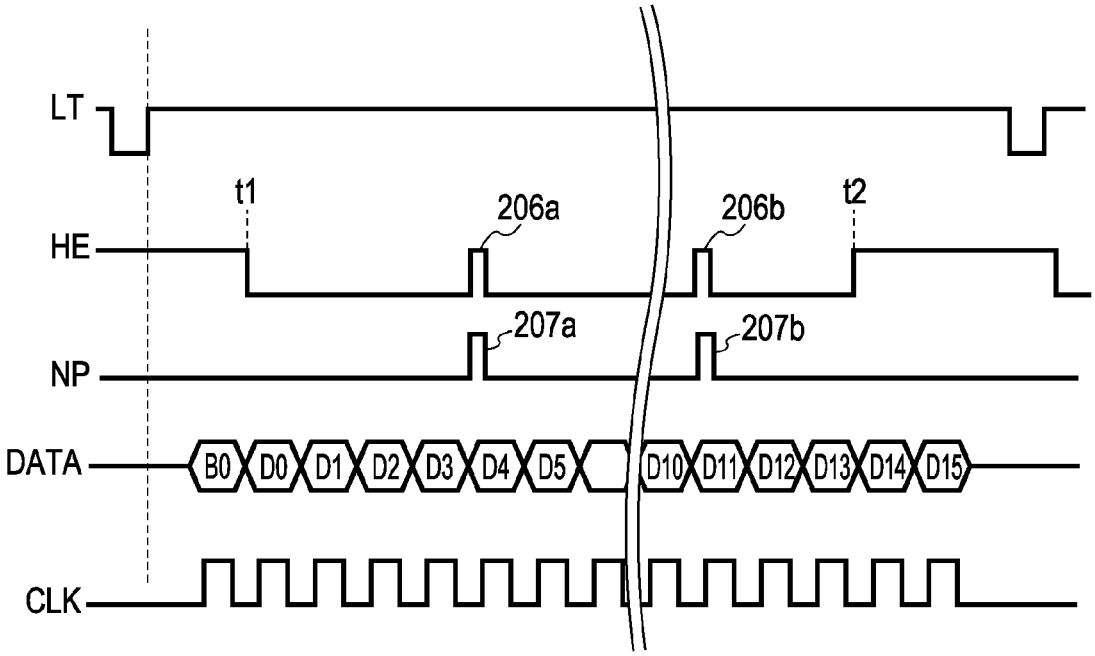
FIG. 2 illustrates example signals input to or generated in the recording head according to the first exemplary embodiment.

FIG. 2 is a timing chart of the signals input to or generated in the ink-jet recording head. In FIG. 2, the number of groups (n) is sixteen. A data signal DATA is transferred from a recording apparatus in a serial manner in synchronization with a transfer clock signal CLK. The data signal DATA includes 1-bit block information (B0) and 16-bit image data (D0 to D15). Herein, sixteen recording elements constitute one block, and the 16-bit data is transferred such that each of the data components is assigned to a corresponding recording element. In FIG. 2, the recording head has two blocks. Block to be driven is designated by block information (B0).

The image data is transferred to the shift register 103 shown in FIG. 1A, and held by the latch circuit 106 shown in FIG. 1A in synchronization with the latch signal LT. The shift register 103 outputs the image data in a parallel manner according to the latch signal LT. The switching elements 102 are enabled to be switched on between timings t1 and t2, that is, while the logical value of the heat-enable signal HE is at a low level (active). This allows current to flow in the heaters 101, and the heat of the heaters causes ink to foam. Due to the foaming, ink is ejected from nozzles.

For ease of explanation, an operation in one group (Gr. 1) will be described with reference to FIG. 2. Pulses 206*a* and 206*b* are superimposed on the heat-enable signal HE. The pulse-detecting circuit 107 outputs the control signal NP including pulses 207*a* and 207*b*. Herein, the pulse 207*a* is used for starting the output of the enable signal, and the pulse 207*b* is used for stopping the output of the enable signal. In this manner, the enable signal E1 is output on the basis of these pulses.

Figure 3A:
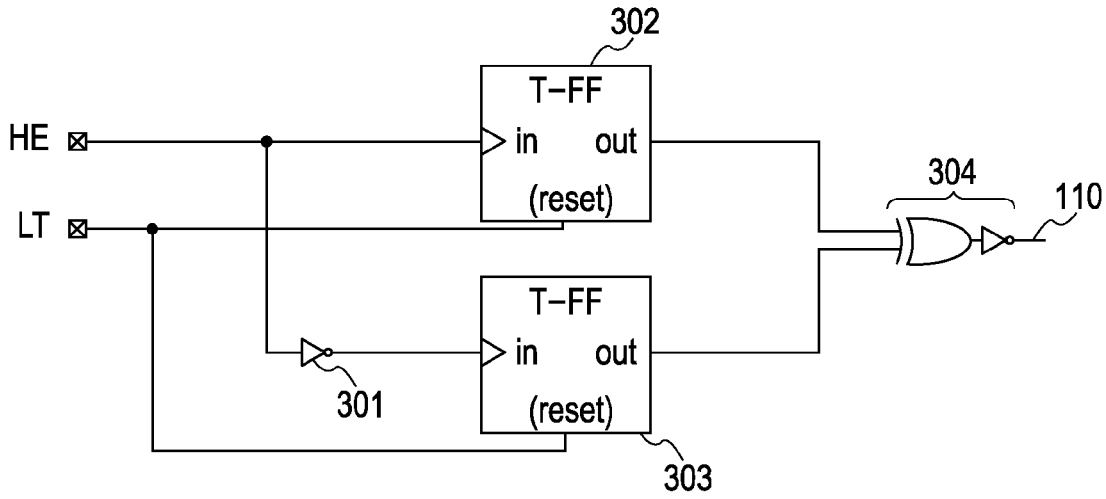
FIGS. 3A and 3B illustrate example pulse-detecting circuits according to the first exemplary embodiment.

FIG. 3A illustrates an example configuration of the pulse-detecting circuit 107. In FIG. 3A, the heat-enable signal HE is input to a T flip-flop (T-FF) 302. The signal obtained by inverting the logical values of the heat-enable signal HE at an inverter circuit 301 is input to a T-FF 303. The outputs from the T-FFs 302 and 303 are ANDed (AND operation) by a logic circuit 304 so that the control signal NP is generated.

Figure 3B:
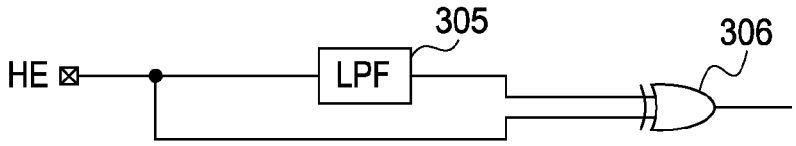

The latch signal LT is input to the T-FFs 302 and 303 as a reset signal. The T-FFs are reset every time the latch signal LT is input. Thus, the pulses can be periodically detected. The T-FFs are used in the circuit configuration shown in FIG. 3A. However, as shown in FIG. 3B, the heat-enable signal HE and a signal obtained by removing the short pulses from the heat-enable signal HE using a low-pass filter 305 can be input to a logic circuit 306 so that the control signal NP is generated through exclusive OR operations by the logic circuit 306.

Figure 4:
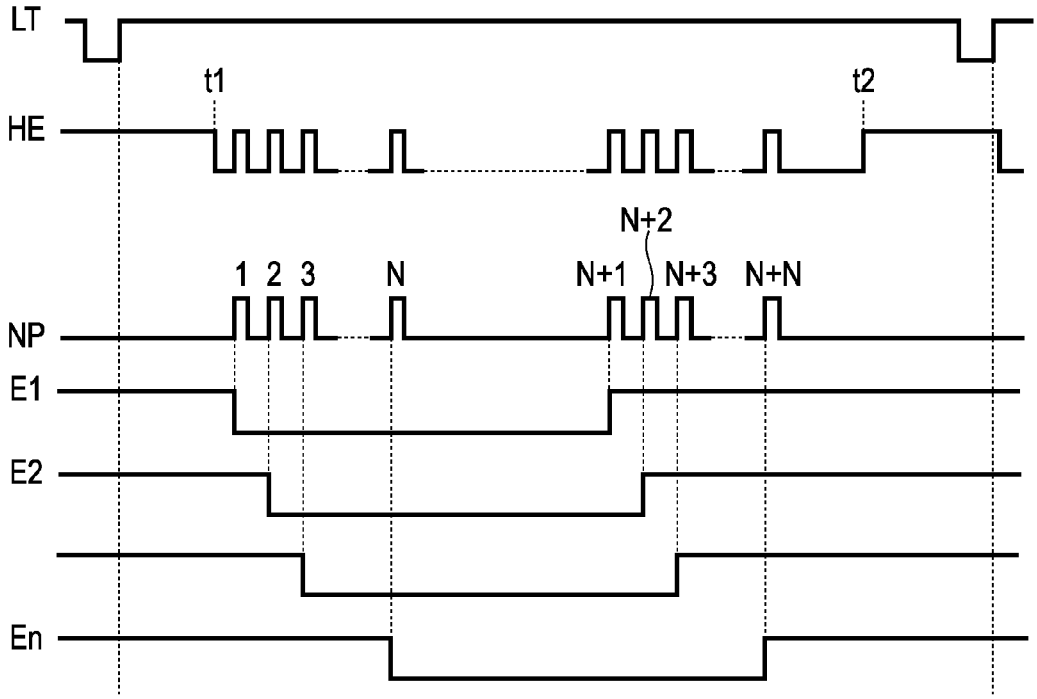
FIG. 4 illustrates example signals input to or generated in the recording head according to the first exemplary embodiment.

FIG. 4 illustrates timings of the signals to be supplied to the switching elements 102. In FIG. 4, the number of groups of the recording head is N. The recording elements of the recording head are enabled to be driven between the timings t1 and t2. The pulse-detecting circuit 107 outputs the control signal NP including a plurality of pulses in accordance with the pulses superimposed on the heat-enable signal HE, the number of the pulses in the control signal NP being the same as that of the pulses superposed on the heat-enable signal HE.

The enable signal E1 is a heat-enable signal for the first group. The enable signal E1 becomes active when a first pulse in the control signal NP is output, and becomes inactive when a (N+1)th pulse in the control signal NP is output. That is, the width of the pulse supplied to the heaters 101 included in the first group corresponds to the period between the first pulse and the (N+1)th pulse.

The enable signal E2 is a heat-enable signal for the second group. The enable signal E2 becomes active when a second pulse in the control signal NP is output, and becomes inactive when a (N+2)th pulse in the control signal NP is output. That is, the width of the pulse supplied to the heaters 101 included in the second group corresponds to the period between the second pulse and the (N+2)th pulse. Similarly, the width of the pulse supplied to the heaters 101 included in the Nth group corresponds to the period between the Nth pulse and the 2Nth ((N+N)th) pulse.

With the above-described configuration, the timings for driving the recording elements in each group can be set so as to differ from each other, and peaks in noise can be reduced.

Second Exemplary Embodiment

Figure 5:
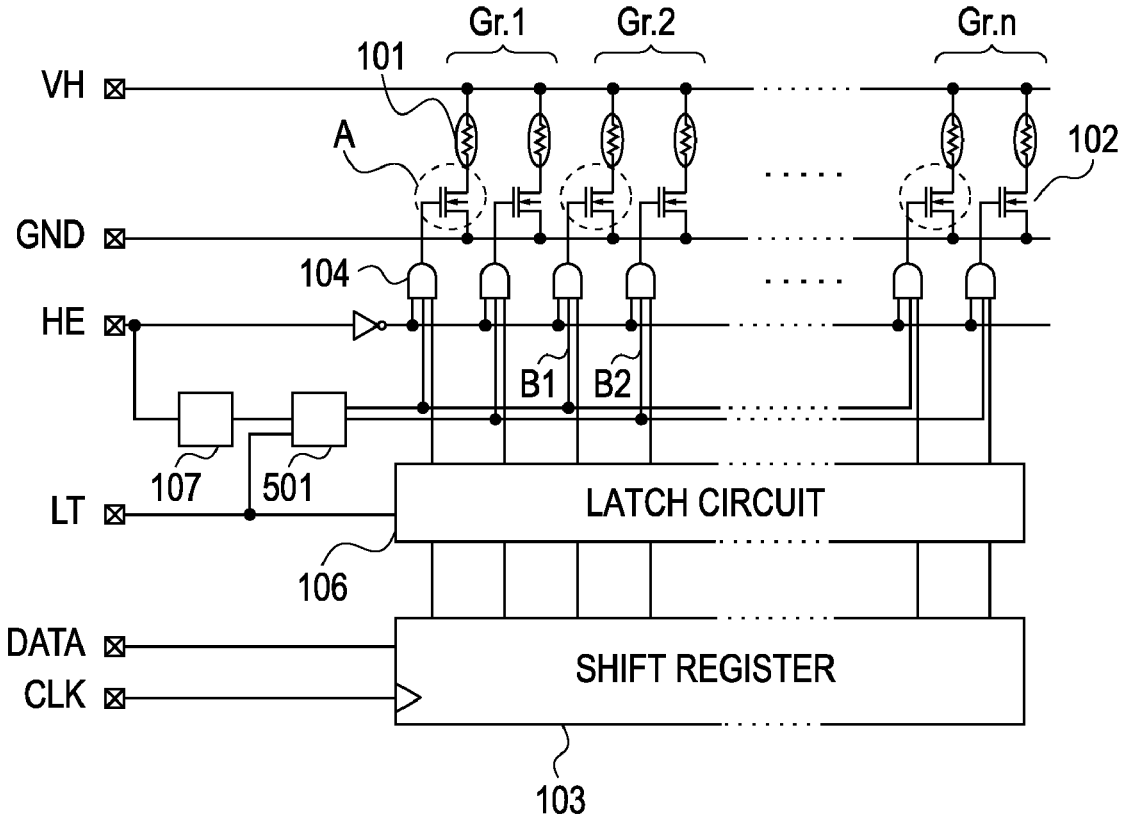
FIG. 5 illustrates an example control circuit of a recording head according to a second exemplary embodiment of the present invention.

FIG. 5 is a block diagram illustrating an example equivalent circuit according to a second exemplary embodiment of the present invention. Descriptions of components similar to those shown in FIG. 1A are omitted, and only differences will be described.

The pulse-detecting circuit (pulse-generating circuit) 107 detects pulses superimposed on the heat-enable signal HE, and outputs the control signal NP including pulses with a predetermined width. A decoder 501 counts the number of pulses in the control signal NP output from the pulse-detecting circuit 107. The decoder 501 outputs block-selection signals according to the count value. The decoder 501 inputs latch signal LT. The decoder 501 outputs block-selection signals according to the latch signal LT. For ease of explanation, the recording head includes two blocks in each group so that the number of time divisions (sharing) is set to two in FIG. 5. For example, the decoder 501 outputs a signal B1 for selecting the first block when the count value is one, and outputs a signal B2 for selecting the second block when the count value is two. When the number of time divisions is eight, for example, the decoder 501 outputs eight kinds of signals B1 to B8 such that eight blocks can be selected.

Figure 6A:
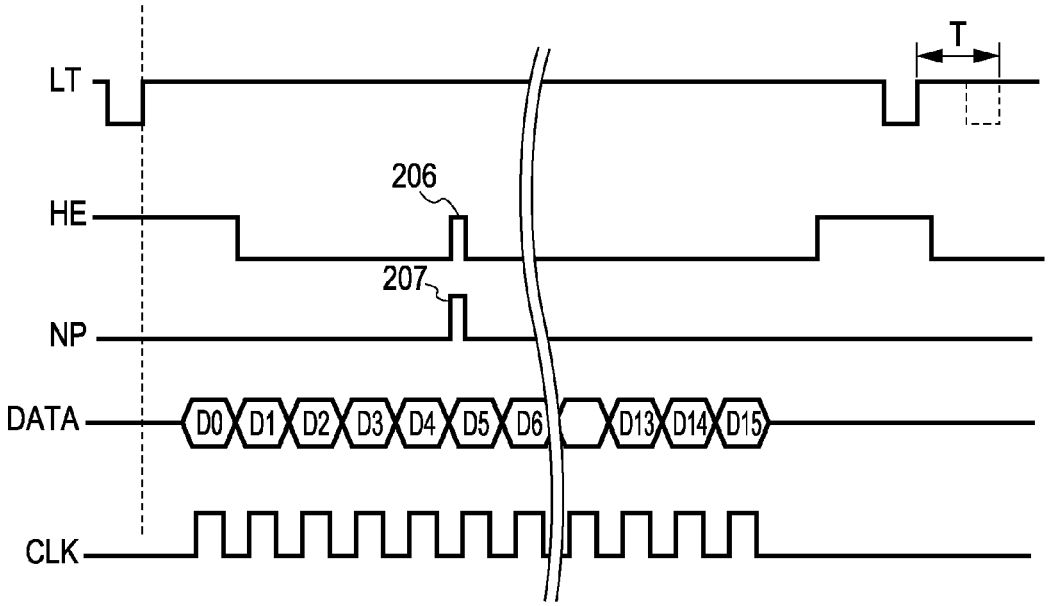
FIGS. 6A and 6B illustrate example signals input to or generated in the recording head according to the second exemplary embodiment.

FIG. 6A is a timing chart of the signals input to or generated in the ink-jet recording head according to the second exemplary embodiment. In FIG. 6A, the pulse-detecting circuit 107 detects a pulse 206 superimposed on the heat-enable signal HE, and outputs the control signal NP including a pulse 207. The decoder 501 outputs the signal B1 for selecting the first block as described above.

Figure 6B:
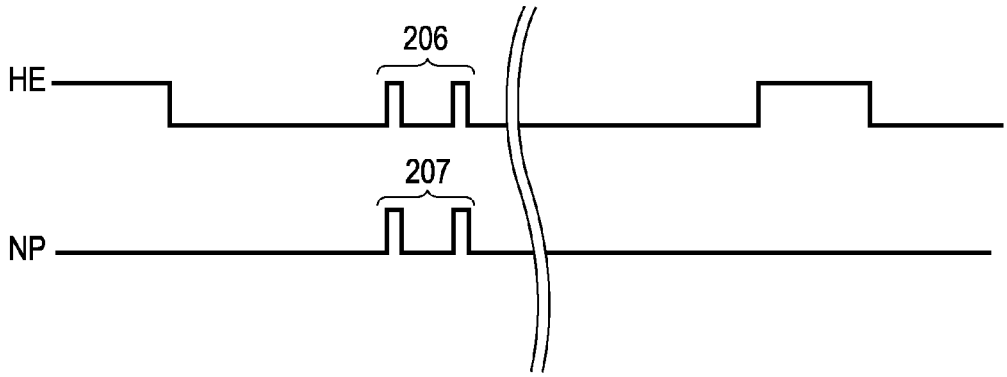

Similarly, in FIG. 6B, the pulse-detecting circuit 107 detects two pulses 206 superimposed on the heat-enable signal HE, and outputs the control signal NP including two pulses 207. The decoder 501 outputs the signal B2 for selecting the second block as described above.

Figure 10:
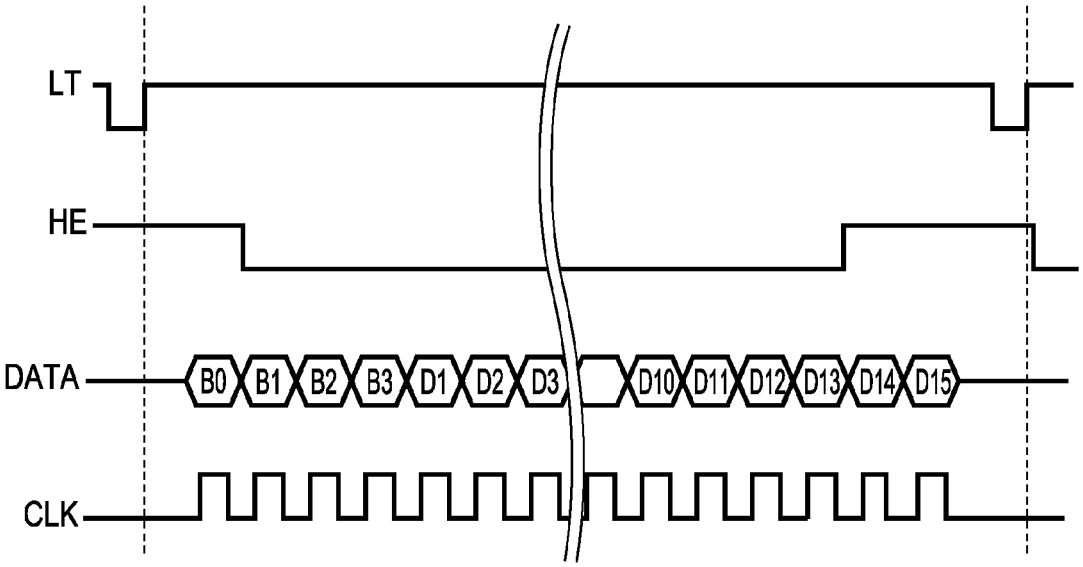
FIG. 10 PRIOR ART
FIG. 10 illustrates example signals supplied to the known recording head.

With the configuration according to the second exemplary embodiment, the interval between two successive inputs of the latch signal LT can be reduced since the information on the block specification (B0 to B3) does not have to be transferred with the image data (D0 to D15). FIG. 6A illustrates that the interval is reduced by a time T compared with that in the known technology shown in FIG. 10.

As the number of blocks that constitute a recording-element array is increased, the number of bits of the information on the block specification becomes large. With the configuration according to the second exemplary embodiment, the volume of the data to be transferred can be effectively reduced, and at the same time, the amount of noise can be reduced.

Ink-Jet Recording Apparatus

Figure 8:
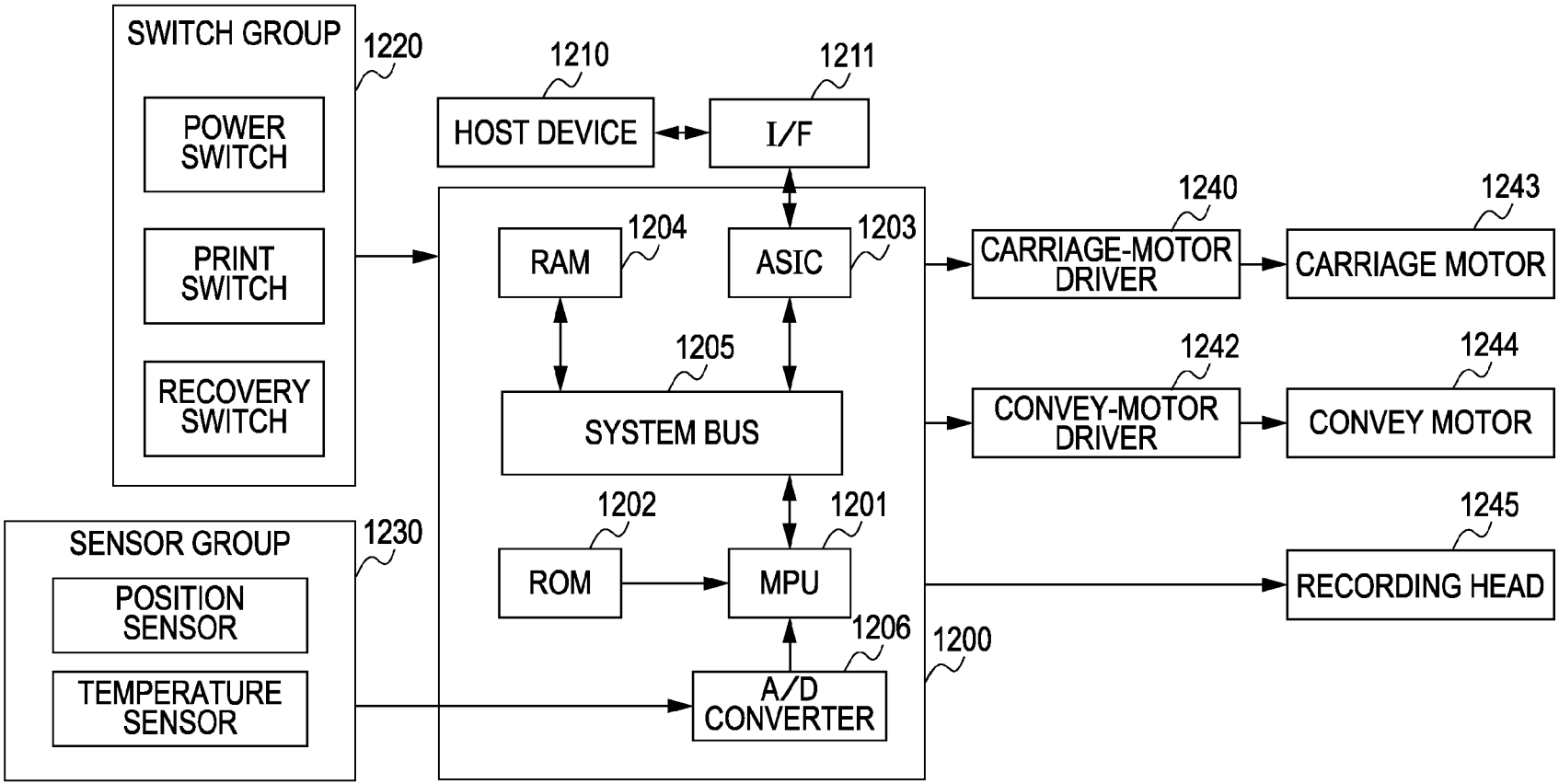
FIG. 8 is a block diagram of an example ink-jet recording apparatus to which the exemplary embodiments of the present invention are applicable.
Figure 9:
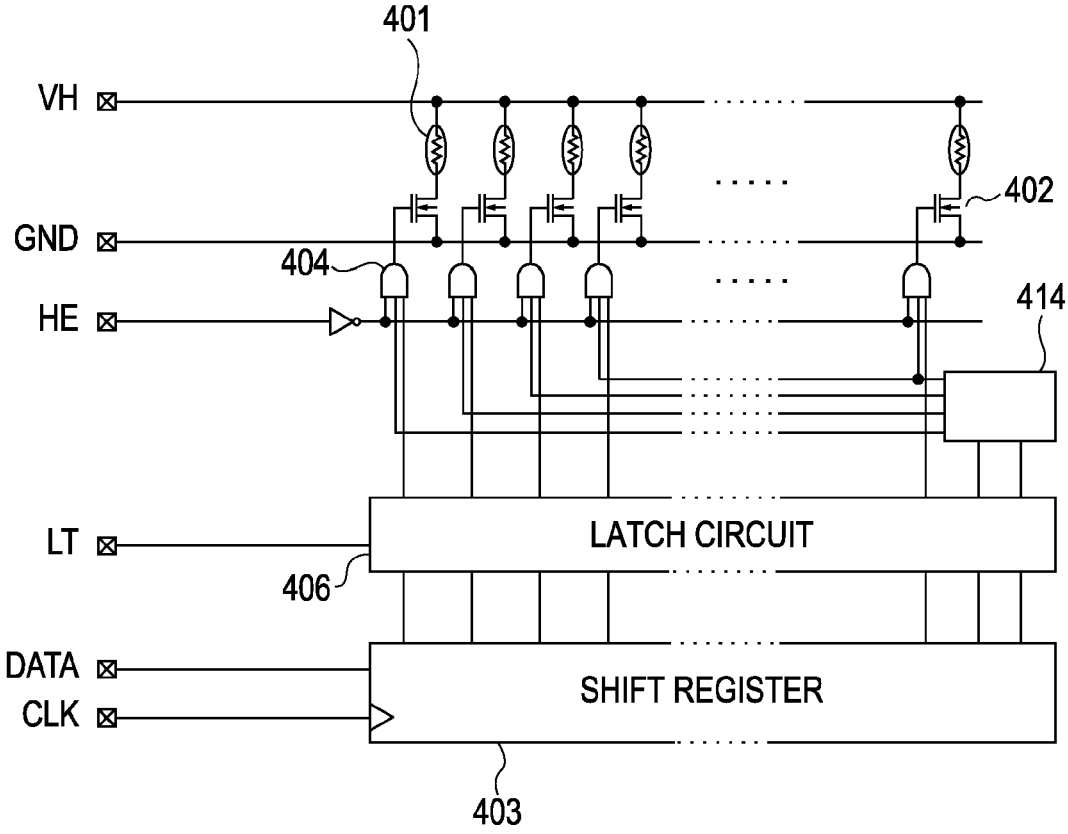
FIG. 9 PRIOR ART
FIG. 9 illustrates an example driving circuit of a known recording head.

Next, an example control configuration of an ink-jet recording apparatus to which the above-described exemplary embodiments are applicable will be described. The ink-jet recording apparatus is capable of recording on recording media by driving a recording head to scan over the recording media and conveying the recording media. FIG. 8 is an example control block diagram of the ink-jet recording apparatus. A controller 1200 includes, for example, a microprocessing unit (MPU) 1201, a read-only memory (ROM) 1202, an application-specific integrated circuit (ASIC) 1203, a random-access memory (RAM) 1204, a system bus 1205, and an analog-to-digital (A/D) converter 1206. Herein, the ROM 1202 stores programs that control the ink-jet recording apparatus, tables, and other fixed data.

The ASIC 1203 generates the transfer clock signal CLK, the latch signal LT, and the heat-enable signal HE; and transfers these signals to a recording head 1245. The ASIC 1203 superimposes pulses on the heat-enable signal HE. In addition, the ASIC 1203 reads image data from the RAM 1204, and transfers the image data to the recording head.

The ASIC 1203 outputs a control signal to a carriage-motor driver 1240 so as to drive a carriage motor 1243. The ASIC 1203 also outputs a control signal to a convey-motor driver 1242 so as to drive a convey motor 1244. The carriage motor 1243 is a driving source for driving the recording head to scan, and the convey motor 1244 is a driving source for conveying the recording media.

The RAM 1204 is used for storing image data and data for program execution. The MPU 1201, the ASIC 1203, and the RAM 1204 are connected to each other via the system bus 1205. The A/D converter 1206 receives analog signals from a sensor group 1230 (described below), performs analog-to-digital conversion, and supplies digital signals to the MPU 1201.

In FIG. 8, a host device 1210 can include computers, image-scanning apparatuses, and digital cameras. The host device 1210 and the recording apparatus transmit/receive, for example, image data, commands, and status signals to/from each other via an interface (I/F) 1211. The image data is input, for example, in the form of raster graphics. A switch group 1220 includes, for example, a power switch, a print switch, and a recovery switch. The sensor group 1230 detects the state of the apparatus, and includes, for example, a position sensor and a temperature sensor.

Other Exemplary Embodiments

Figure 7:
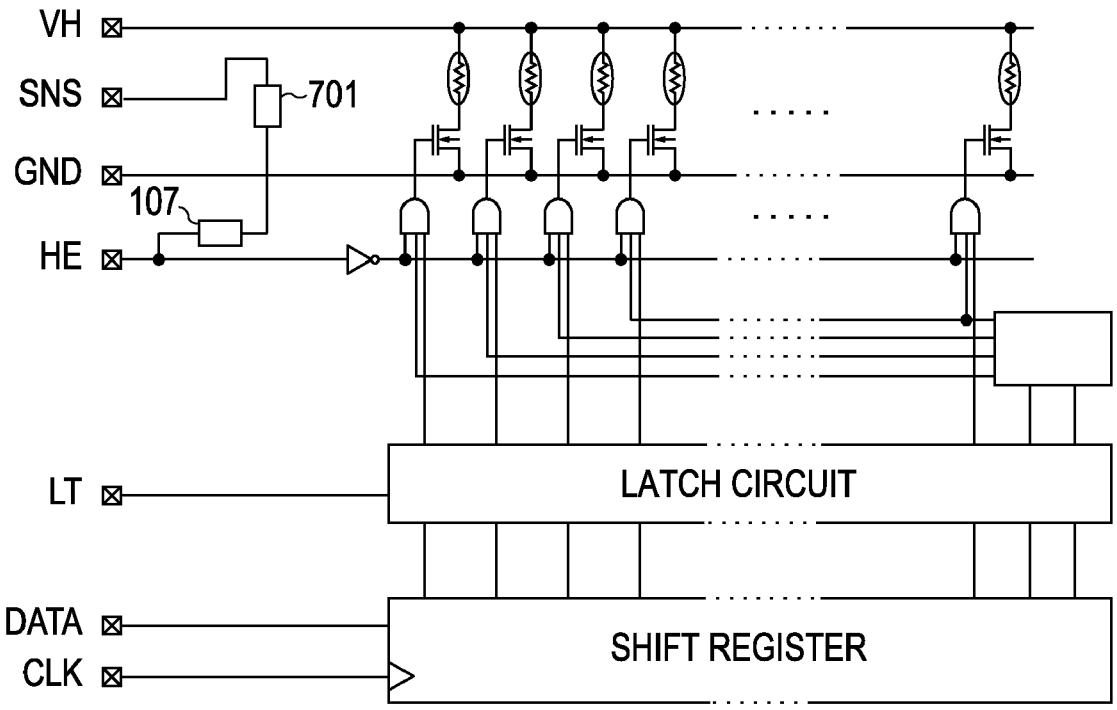
FIG. 7 illustrates an example control circuit of a recording head according to another exemplary embodiment of the present invention.

FIG. 7 is a block diagram illustrating an example equivalent circuit according to another exemplary embodiment of the present invention. Descriptions of components similar to those shown in FIG. 5 are omitted, and only differences will be described.

In FIG. 7, the pulse-detecting circuit (pulse-generating circuit) 107 detects pulses superimposed on the heat-enable signal HE, and controls a temperature-detecting unit (temperature-detecting circuit) 701 on the basis of the pulses. The temperature-detecting unit 701 outputs voltage serving as a signal SNS to the recording apparatus. In this manner, the pulses can be used for controlling the temperature-detecting circuit instead of the driving circuit of the recording elements.

Although a recording head and a recording apparatus were described as above, the numerical values related to the configurations are not limited to those described above. For example, the number of heaters (resistive heating elements) constituting a group is not limited to two or sixteen, and can be eight or thirty-two. Moreover, the number of heaters constituting a block is also not limited to eight or sixteen.

While the present invention has been described with reference to exemplary embodiments, it is to be understood that the invention is not limited to the disclosed exemplary embodiments. The scope of the following claims is to be accorded the broadest interpretation so as to encompass all modifications and equivalent structures and functions.

This application claims the benefit of Japanese Patent Application No. 2008-169335 filed Jun. 27, 2008, which is hereby incorporated by reference herein in its entirety.

What is claimed is:

1. A recording head comprising:

a plurality of recording elements grouped into a first plural number of groups, wherein the recording elements included in the groups are assigned to a second plural number of different timings for driving the recording elements;

driving units configured to drive the recording elements included in the groups at the second plural number of different timings;

an input unit configured to receive an enable signal that defines a period during which the driving of the recording elements is enabled at one ink ejection, wherein the enable signal is combined with pulses during the period based on the first plural number;

a determining unit configured to detect the pulses during the period defined by the enable signal and determine a start timing and an end timing of a control signal based on a result of detection, wherein the control signal allows the driving units to drive the recording elements in the group; and a generating unit configured to generate the control signal based on the start timing and the end timing.

2. The recording head according to claim 1, wherein the generating unit generates signals for selecting the recording elements to be driven by the driving units.

3. A recording apparatus capable of recording using the recording head according to claim 1, the recording apparatus comprising:

a generating unit that generates the enable signal; and a transfer unit that transfers the enable signal generated at the generating unit to the recording head in synchronization with predetermined timings.

4. A recording apparatus capable of recording using the recording head according to claim 1, the recording apparatus comprising:

a generating unit that generates the enable signal; and a transfer unit that transfers the enable signal generated at the generating unit to the recording head in synchronization with each timing of the second plural number of different timings.

* * * * *